US006321934B1

(12) United States Patent
Immel

(10) Patent No.: US 6,321,934 B1
(45) Date of Patent: Nov. 27, 2001

(54) CONTAINER DISPENSING APPARATUS

(75) Inventor: Nancy K. Immel, Forest Lake, MN (US)

(73) Assignee: Berg Company, a division of DEC International, Inc., Madison, WI (US)

( * ) Notice: Subject to any disclaimer, the term of this patent is extended or adjusted under 35 U.S.C. 154(b) by 0 days.

(21) Appl. No.: 09/444,442

(22) Filed: Nov. 22, 1999

(51) Int. Cl.[7] ..... B65H 3/00
(52) U.S. Cl. ..... 221/192; 221/197
(58) Field of Search ..... 221/192, 197, 221/191, 194, 131, 268, 282, 92, 93, 123, 133

(56) References Cited

U.S. PATENT DOCUMENTS 4,485,937 12/1984 Adams .
5,927,539 7/1999 Truitt et al. .

FOREIGN PATENT DOCUMENTS

404137194 * 5/1992 (JP) ..... 221/192

* cited by examiner

*Primary Examiner*—Kenneth W. Noland
(74) *Attorney, Agent, or Firm*—Andrus, Sceales, Starke & Sawall, LLP

(57) ABSTRACT

A dispensing apparatus having a refrigerated compartment for receiving a plurality of bottle cartridges containing bottle container. A bottle latching mechanism holds the bottles within the cartridge as the cartridge and bottle containers are inserted into the refrigerated compartment. A bottle lifting mechanism located proximate the end of the rows of multiple cartridges lifts the bottles upward until the top bottle rolls onto a sloped dispensing platform where a person can remove the bottle from the dispensing apparatus by pressing a lever to allow a bottle to roll past a flexible window and out of the bottle dispenser to a position where a person can pick up the bottle.

13 Claims, 8 Drawing Sheets

CONTAINER DISPENSING APPARATUS

FIELD OF THE INVENTION

This invention relates generally to dispensing systems and more particularly to a bottle dispensing system for quickly dispensing a bottle from a refrigerated compartment.

BACKGROUND OF THE INVENTION

The concept of a dispensing mechanism for dispensing metal beverage containers is known in the art and generally comprise a refrigerated compartment and a mechanism for on demand delivering one beverage container at a time. In one type of beverage container the beverage containers, which are usually made of aluminum, are stacked in a winding tray.

In another embodiment, the beverages container roll from a series of trays into a dispensing mechanism. The handling of beverage containers is facilitated by the uniform cylindrical shape of the beverage containers.

The present invention comprise a dispensing apparatus capable of handling bottle containers that lack the uniform cylindrical shape of metal beverage containers. Typically, the bottle containers are made of plain or colored glass and are used to hold beer. Because of the unusual shape of the bottle containers and the use of glass in the bottle containers it makes it difficult to use the apparatus for dispensing metal beverage container for dispensing bottle containers. The present invention provides a bottle container dispenser that quickly dispenses a refrigerated bottle on demand making it suitable for use in bars or the like where a bartender must quickly serve a number of patrons.

SUMMARY OF THE INVENTION

Briefly, the present invention comprises a dispensing apparatus having a refrigerated compartment for receiving a plurality of bottle cartridges containing bottle containers. A bottle latching mechanism holds the bottles within the cartridge as the cartridge and bottle containers are inserted into the refrigerated compartment. A bottle lifting mechanism located proximate the end of the rows of multiple cartridges lifts the bottles upward until the top bottle rolls onto a sloped dispensing platform where a person can remove the bottle from the dispensing apparatus by pressing a lever to allow a bottle to roll past a flexible window and out of the refrigerated compartment to a position where a person can pick up the bottle.

DESCRIPTION OF THE PREFERRED EMBODIMENT

Figure 1:
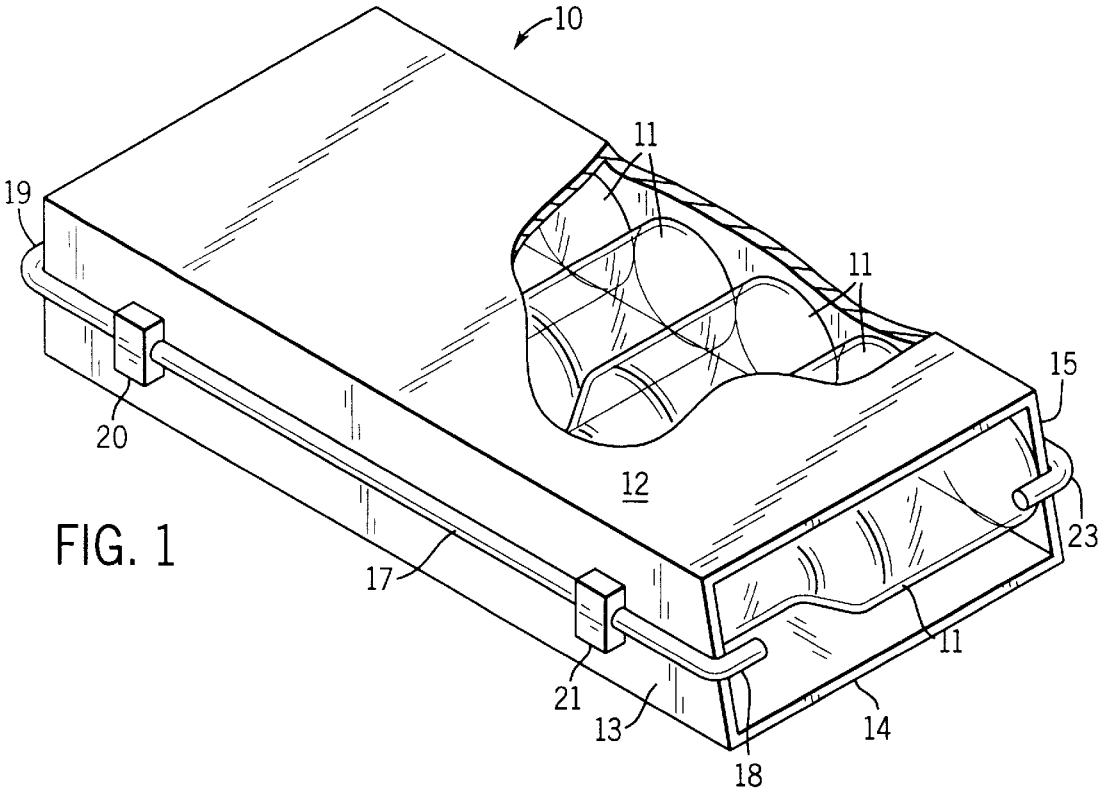
FIG. 1 shows a perspective and cut-away view of a bottle cartridge for holding a plurality of bottle containers.

FIG. 1 shows a perspective and partially cut-away view of a bottle cartridge 10 for holding a plurality of bottle containers 11 therein. The cartridge 10 comprises a rectangular shaped container having a top 12, a bottom 14, a first side 13 and a second side 15. One end of the cartridge 10 is open to permit insertion and removal of bottles 11 from the cartridge 10. In order to prevent bottles 11 from falling out of the open end of cartridge 10 there is provided a first bottle latching mechanism comprising an elongated member 17 that has an extension 18 for engaging one end of a bottle container 11 and a hand lever 19 on the opposite end for rotationally engaging or disengaging the extension 18. The elongated member 17 is held in axially rotational position on the side of cartridge 10 by supports 20 and 21. Supports 20 and 21 can include some type of indent so that the latching rod 17 remains in position until the cartridge is ready for use. FIG. 1 shows latching rod 17 in the bottle holding position with bottle stop 18 extending inward to prevent one end of the bottle container 11 from falling out of cartridge 10. Similarly, a second bottle latching member 23 is located on the opposite side of cartridge 10 with bottle stop 24 extending inward to prevent the other end of the bottle container from falling out of cartridge 10. Bottle latching members 17 and 23 are identical and can be axially rotated to allow for removal or insertion of bottles into the compartment within cartridge 10.

Figure 2:
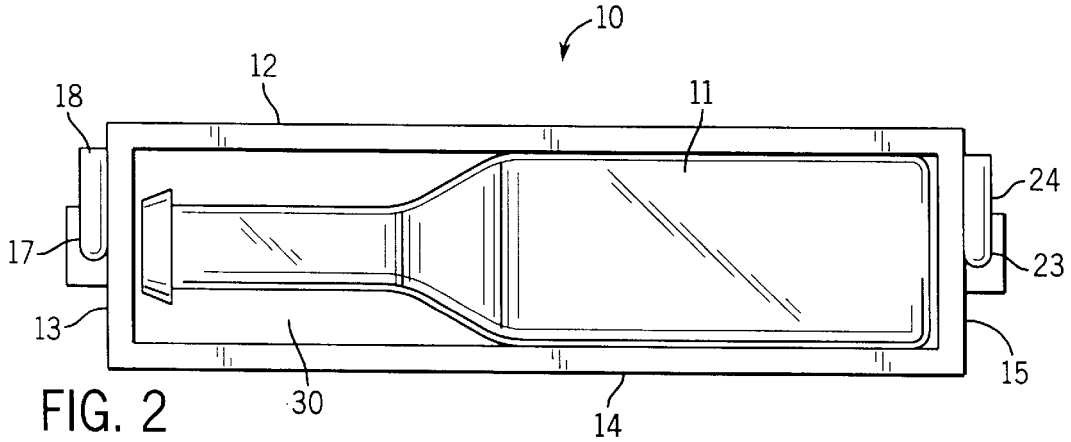
FIG. 2 shows an end view of the open end of the bottle cartridge of FIG. 1 with a pair of bottle retainers located in the non-bottle retaining condition.

Referring to FIG. 2 there is shown an end view of the bottle cartridge 10 of FIG. 1 with the bottle latching members 17 and 23 shown in the open condition wherein a bottle can be dispensed from cartridge 10. In the open condition, extension 18 and extension 24 are in a vertical position. In the vertical position, the extensions 18 and 24 do not protrude into the compartment 30 within cartridge 10 so that a bottle 11 within cartridge 10 is free to be discharged through the open end of the cartridge 10. On the other hand if the extensions were rotated to the condition as shown in FIG. 1 a bottle could not be inserted or removed from bottle cartridge 10.

Figure 2A:
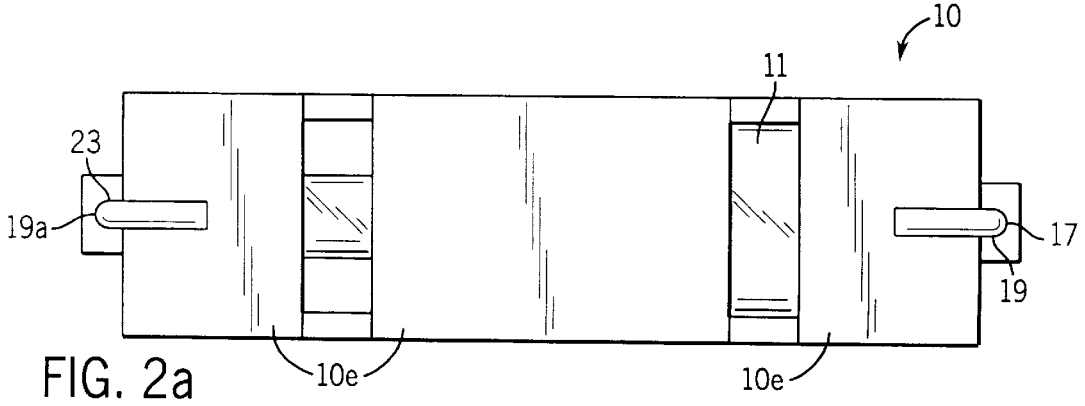
FIG. 2*a* shows an end view of the closed end of the bottle cartridge of FIG. 1 with the hand levers of the bottle retainers rotated into the bottle retaining condition.

FIG. 2*a* shows an end view of the opposite end of bottle cartridge 10 showing hand lever 19 and 19*a* in the closed condition and in position for axial rotation to allow bottle stop extension 18 and 24 to be rotated to the open condition shown in FIG. 2. An end section 10*e* on cartridge 10 prevents the bottles 11 therein from accidentally falling out of cartridge 10 during the process of loading cartridge 10.

Figure 3:
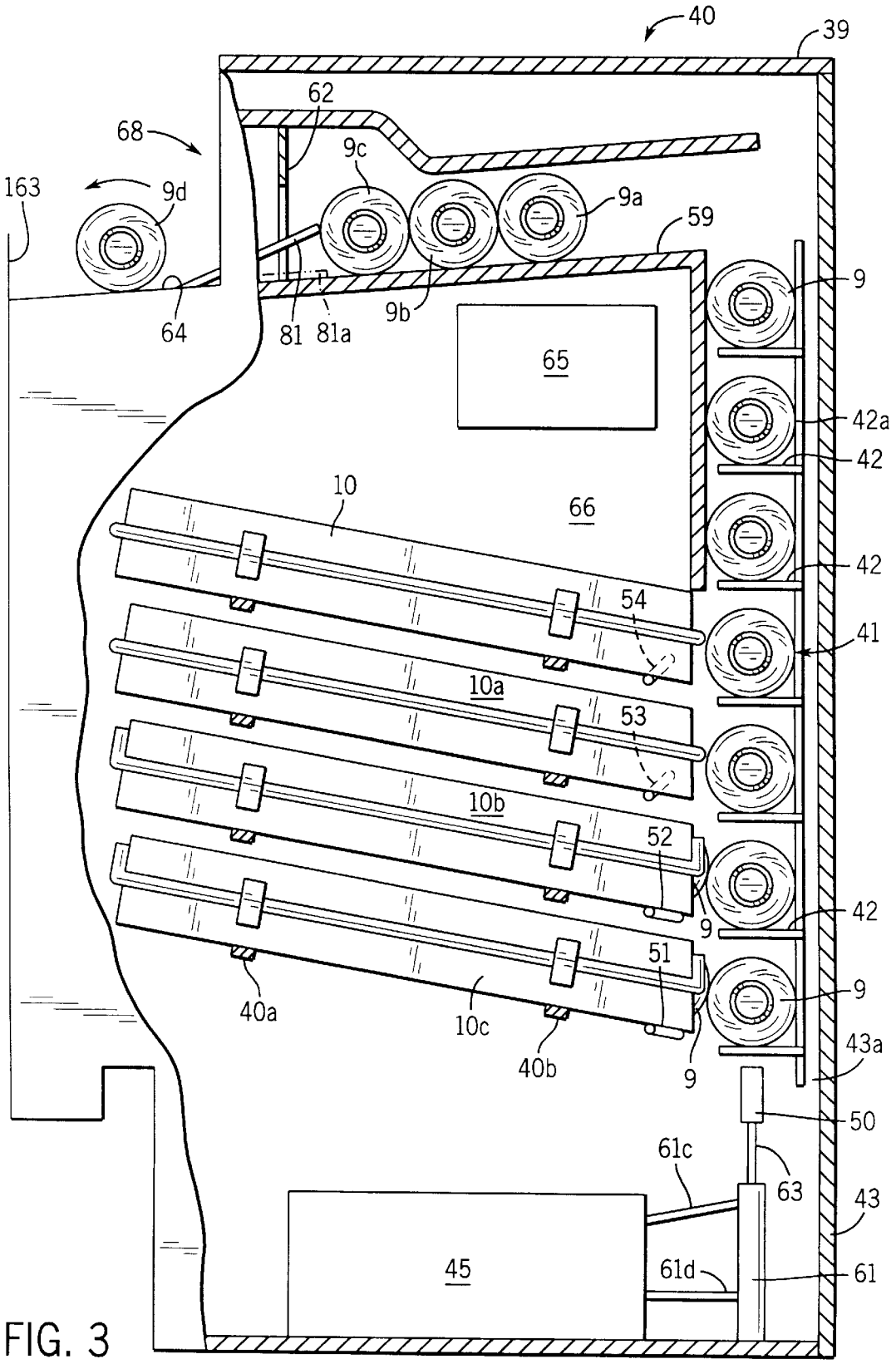
FIG. 3 shows a partial sectional view of a bottle dispenser holding a plurality of bottle cartridges.

FIG. 3 shows a partial sectional view of the bottle dispenser apparatus 40 having a cabinet 39 with a compartment 66 therein. A plurality of bottle cartridges 10, 10*a*, 10*b*, and 10*c* are mounted at an angle so that gravity will normally allow the bottle containers therein to roll toward a vertically positioned bottle rack 41 having a plurality of spaced hinged bottles shelves 42 thereon for receiving and supporting an individual bottle container thereon. Each of bottle shelves 42 are hinged to vertical bottle rack member 42*a* though a hinge (not shown). FIG. 3 shows bottle shelves 42 in the bottle holding condition with the hinged bottle shelves 42 extending perpendicularly outward from member 42*a* to form a vertically oriented bottle rack.

FIG. 3 shows a first rotatable bottle stop bar 51 proximate one end of cartridge 10*c* with bottle stop bar 51 in the open condition to allow bottle 9 to roll out the open end of cartridge 10*c*. Similarly, FIG. 3 shows a second rotatable bottle stop bar 52 proximate one end of cartridge 10*b* also with bottle stop bar 52 in the open condition to allow bottle 9 to be roll out the open end of cartridge 10*c*. A third rotatable bottle stop bar 53 is located proximate one end of cartridge 10*a* with bottle stop bar 53 in the closed condition to prevent bottle 9 from rolling out the open end of cartridge 10*a*. Similarly, a fourth rotatable bottle stop bar 54 is located proximate one end of cartridge 10 with bottle stop bar 54 in the closed condition to prevent bottle 9 from rolling out the open end of cartridge 10. The rotateable bottle stop bars 51, 52, 53 and 54 are rotateable mounted in dispenser 40 and are controlled by the dispenser control mechanism 65. The bottle stop bars are positioned so that counter clockwise rotation will force the bottles back into the their respective cartridges. Consequently, as the bottles held by the hinged bottle shelves 42 are elevated upward they do not come in contact with the bottles in the bottle cartridges thus eliminating excessive bottle noise and possible accidentally breakage of a bottle as the bottles are lifted upwards past the bottles in the cartridges. Thus the bottle stop bars form a set of bottle stoppers that prevent the bottles from rolling free of the bottle cartridge.

Figure 3A:
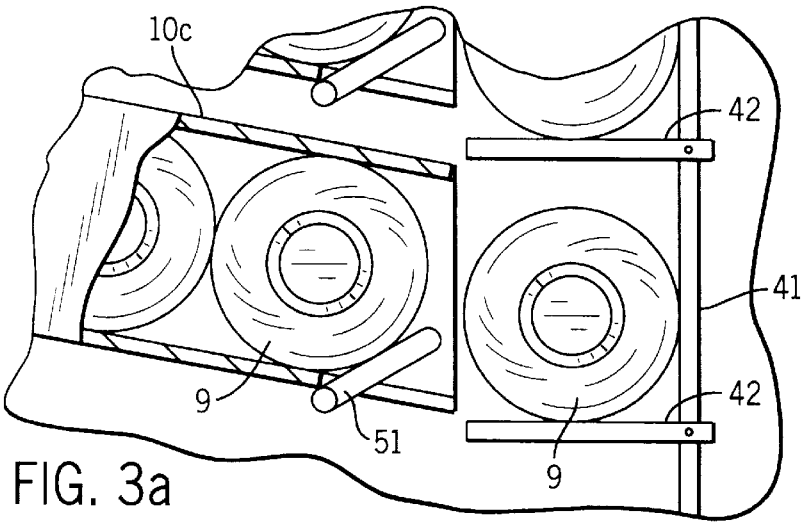
FIG. 3*a* shows a partial cutaway view of the bottle cartridge and the bottle dispenser showing a bottle bar stop for forcing a bottle back into the cartridge when the bottle containers are elevated within the dispensing apparatus.

FIG. 3*a* shows an enlarged partial cutaway view of the bottle cartridge 10*c* and the bottle shelf 42 with bottle stop bar 51 rotated to an upward angle to prevent bottle 9 in cartridge 10*c* from rolling out of cartridge 10*c* and into bottle 9 on lowest hinged bottle shelve 42. To illustrate the bottle retraction capability of the bottle stoppers 51 reference should be made to FIG. 3*a* which shows a partial sectional view of bottle cartridge 10c and bottle rack 41. In the condition shown the bottle stopper 51 has been rotated upward to about the two o'clock position so that the bottle stopper 51 pushes bottle 9 back in the cartridge 10*c* while thus preventing bottle 9 in bottle cartridge 10*c* from being transferred to shelf 42 in bottle rack 41. That is, because there already is a bottle 9 in shelf 42 there is no need to transfer a bottle to bottle rack 41. In addition it is desired to lift the bottles upward the bottles 9 in the cartridge can be held free of the bottles in the bottle rack 41 so the bottles in the lifting rails can be lifted upward without clinking against the bottles in the bottle rack 41.

FIG. 3 shows the hinged shelves 42 for holding the bottles 9 in a horizontal condition. In addition to the hinged shelves 42 there is also proved a pair of bottle lifting rails having lifting dogs thereon. The bottle lifting rails which are located on opposite ends of the bottle container are movable between a lower position and an upper position to lift bottles upward to ramp 59. FIG. 3 shows only a portion of one rail 50 which supported by a two way power cylinder 61 having a retractable rod 63 for elevating and lowering rail 50. A first fluid line 61*c* a connects to power source 45, which is preferably pneumatic, and a second fluid line 61*b* connects to power source 45 to permit raising and lower of rail 50. Power source 45 can comprise a source of pressurized air 45 controllable by a switch on the dispensing mechanism to causes retractable rod 63 to be extended or contracted thorough supply of air into lines 61*c* and 61*d*. Preferably cylinder 43 is a two-way powered pneumatic cylinder although a one-way power cylinder could also be used. Similarly, a second rail is located on the opposite end of bottle 9 to lift the bottle upward. In order to appreciate the bottle lifting rails reference should be made to FIGS. 4 to 9 which show both the bottle lifting rails positioned in conjunction to the hinged bottle shelves 42 during different portions of the bottle lifting cycle where the bottle lifting rails movable vertically between a first filling position and a second bottle delivery position.

Figure 4:
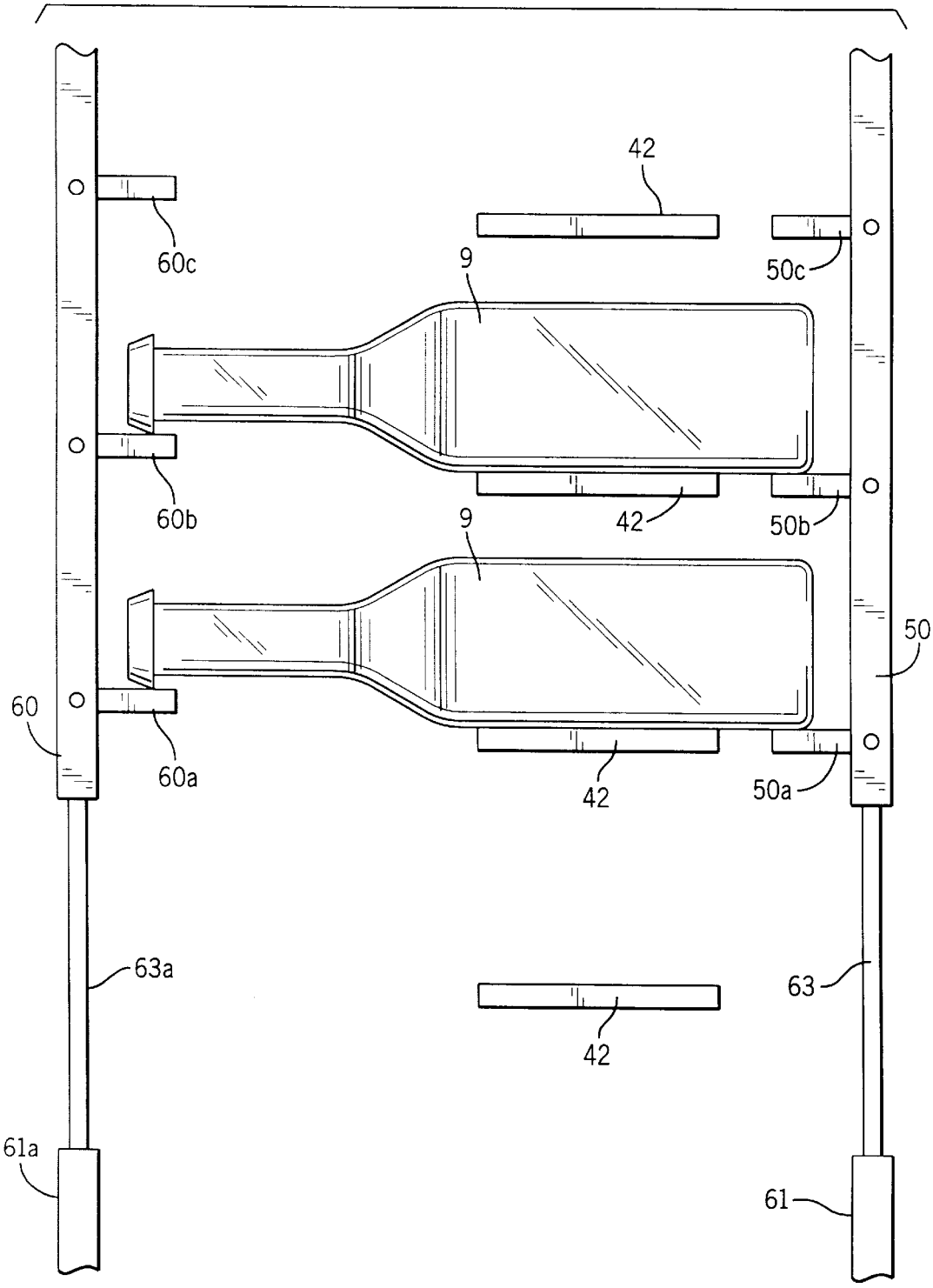
FIG. 4 is a partial view of a pair of parallel spaced bottle lifting rails and the hinged bottle shelves of FIG. 3 prior to lifting the bottles upward toward the dispensing position.

FIG. 4 shows a partial elevation, partial schematic view of the hinged bottle shelves that support the bottles 9 thereon. For ease in understanding the operation the other components of the dispensers are not included in FIGS. 4–9. Located on one end of bottles 9 is rail 50 that has a first hinged dog 50*a*, a second hinged dog 50*b* and a third hinged dog 50*c* that are spaced from each other. Similarly located on the opposite end of bottles 9 is a second rail 60 that has a first hinged dog 60*a*, a second hinged dog 60*b* and a third hinged dog 60*c* that are also spaced from each other. In the condition shown the lower hinged shelf 42 extends perpendicularly outward to support the bottle container 9 thereon and the dogs 60*a* and 50*a* support opposite ends of lower bottle 9. Similarly, middle hinged shelf 42 supports second bottle 9 while the dogs 60*b* and 50*b* support opposite ends of lower bottle 9. The dogs 60*c* and 50*c* are shown in the extended condition but are not supporting a bottle thereon.

Figure 5:
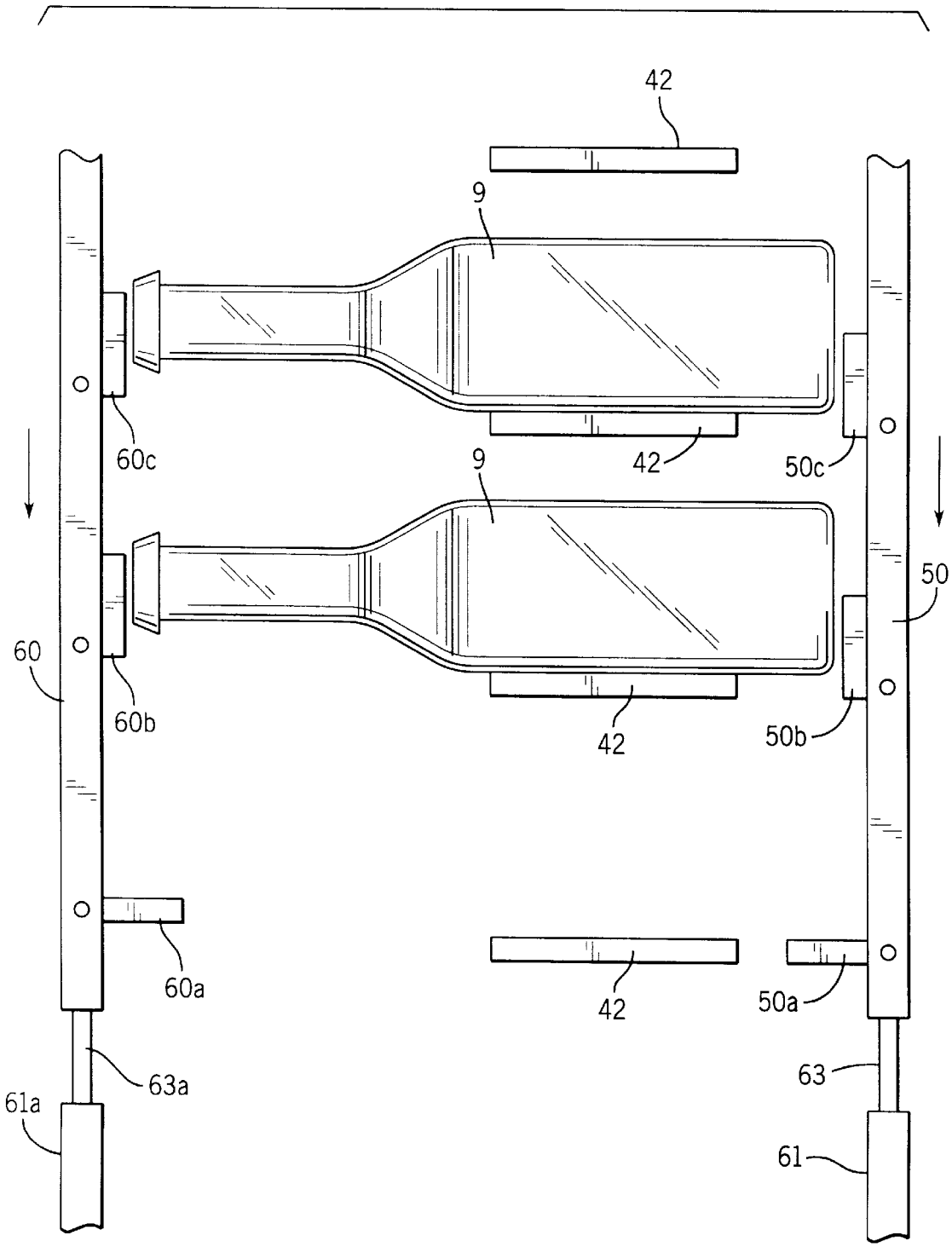
FIG. 5 is a partial view of the bottle lifting rails and the hinged bottle shelves of FIG. 4 illustrating that the bottle lifting rails are moving downward.

Referring to FIG. 5 the bottle containers 9 are shown being supported solely by their hinged shelves 42 as the end rail 50 and 60 are being lowered by cylinders 61 and 61*a*. Note, as rail 50 moves downward in the direction indicated by the arrow the dogs 50*b* and 50*c* pivot upward so that the dogs can slide past the ends of the bottle containers 9. Similarly, as rail 60 moves downward the dogs 60*b* and 60*c* pivot upward to slide past the other ends of bottle container 9 while the bottle containers 9 are being supported by the hinged shelves 42.

Figure 6:
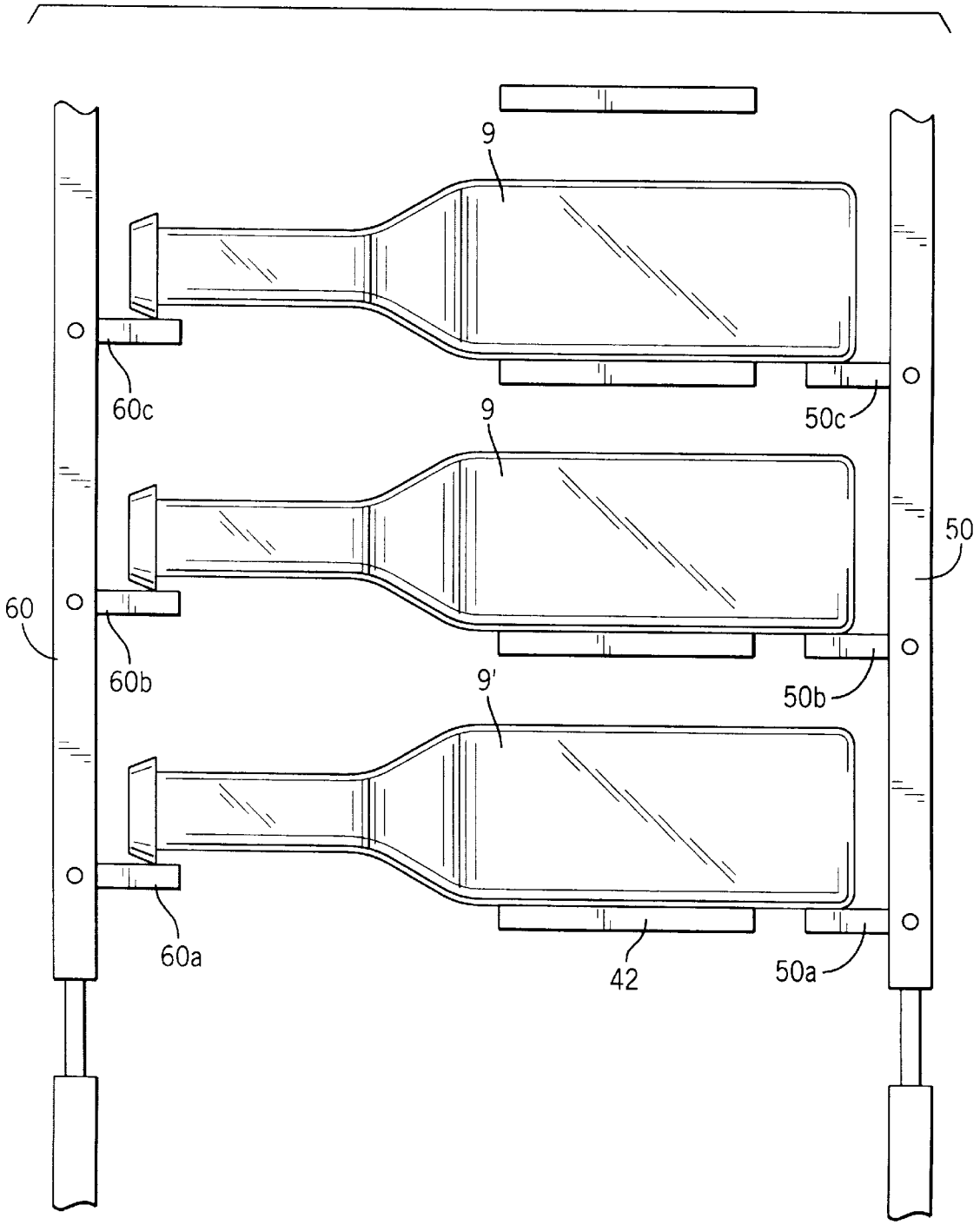
FIG. 6 is a partial view of the bottle lifting rails and the hinged bottle shelves of FIG. 4 illustrating that the bottle lifting rails are in the downward condition with the lifting dogs in a position to lift the bottles upward

FIG. 6 shows that when the rails 50 and 60 are in the lower condition a bottle 9' from a bottle cartridge has been allowed to roll out of the cartridge until one end of the bottle 9' come into contact with dog 60*a* and the other end of bottle 9' comes into contact with dog 50*a*. The three bottles 9, 9 and 9' are now in a condition to be moved vertically upward. In this condition each of the dogs have been lowered and placed in position to elevate a bottle upward.

Figure 8:
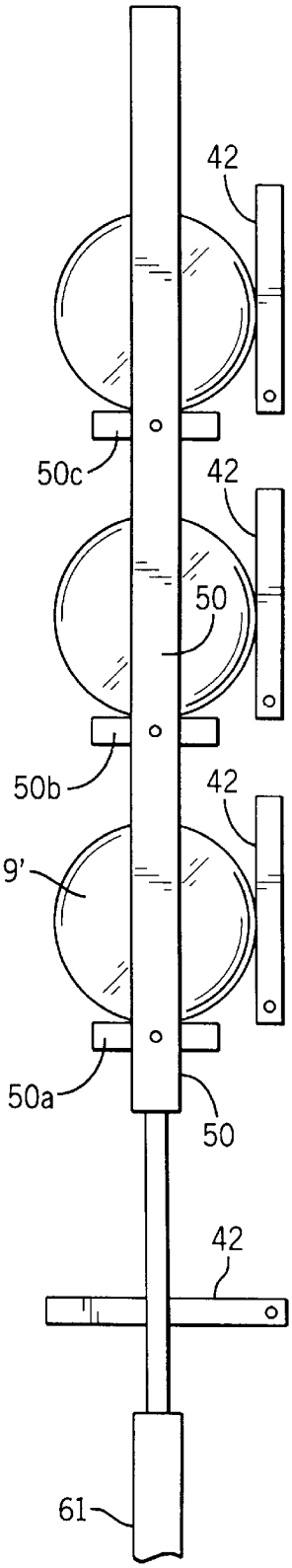
FIG. 8 is a side view of the bottle lifting rails and hinged bottle shelves of FIG. 7.
Figure 7:
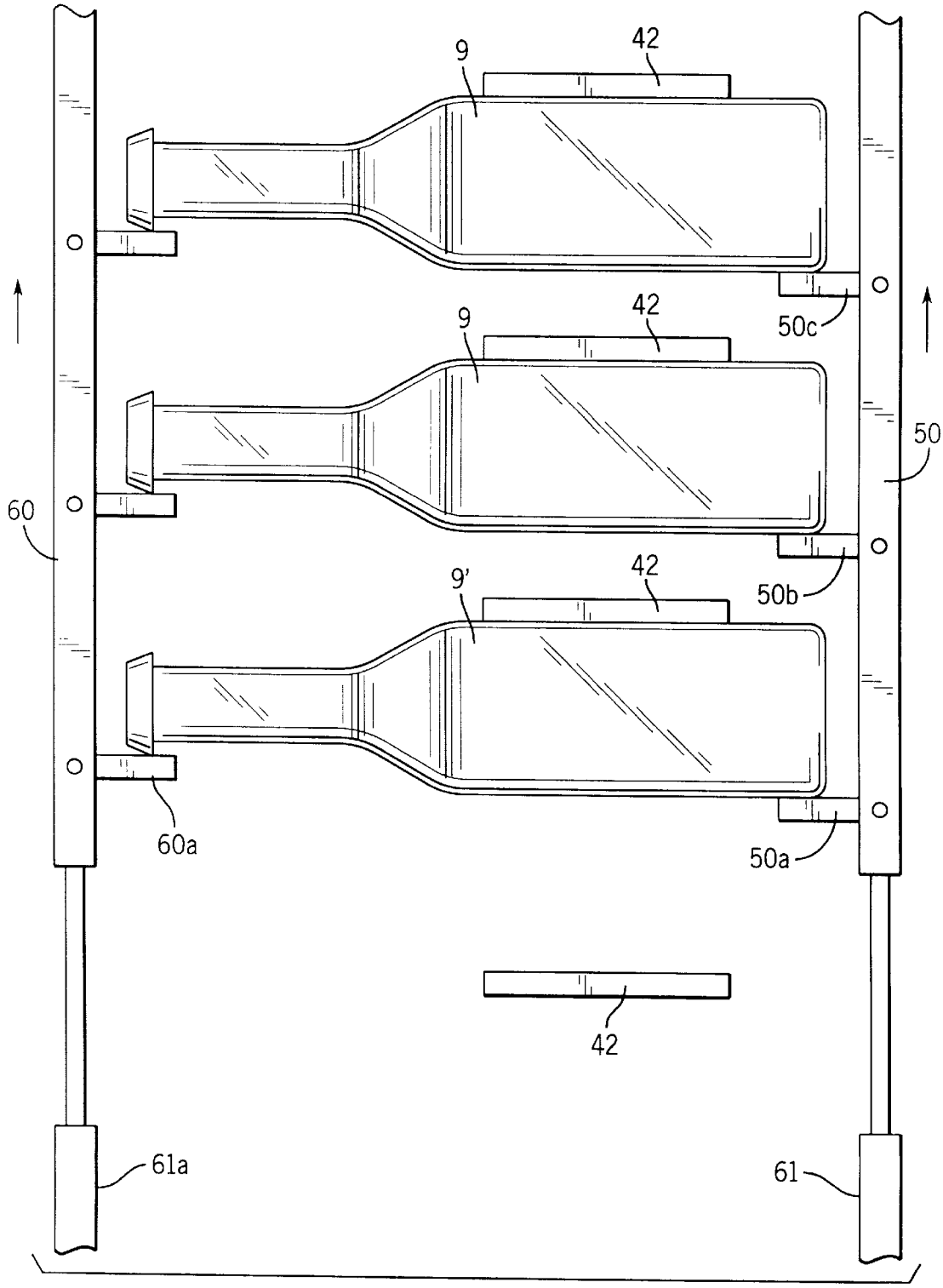
FIG. 7 is a partial view of the bottle lifting rails and the hinged bottle shelves of FIG. 4 illustrating that the bottle lifting rails are lifting the bottles upward with the hinged bottle shelves are pivoted to a vertical out-of-the-way condition.

FIGS. 7 shows the front schematic view of the lifting rails and hinged bottle shelves 42 while FIG. 8 shows the corresponding side schematic view of the lifting rails and hinged bottle shelves 42. Note, in the condition shown, the hinged bottle shelves 42 have been folded upward as the bottles 9, 9 and 9' are lifted upward by the respective bottle dogs on the rails. By allowing the hinged bottle shelves to fold upward all the bottles can be simultaneously lifted upward.

Figure 9:
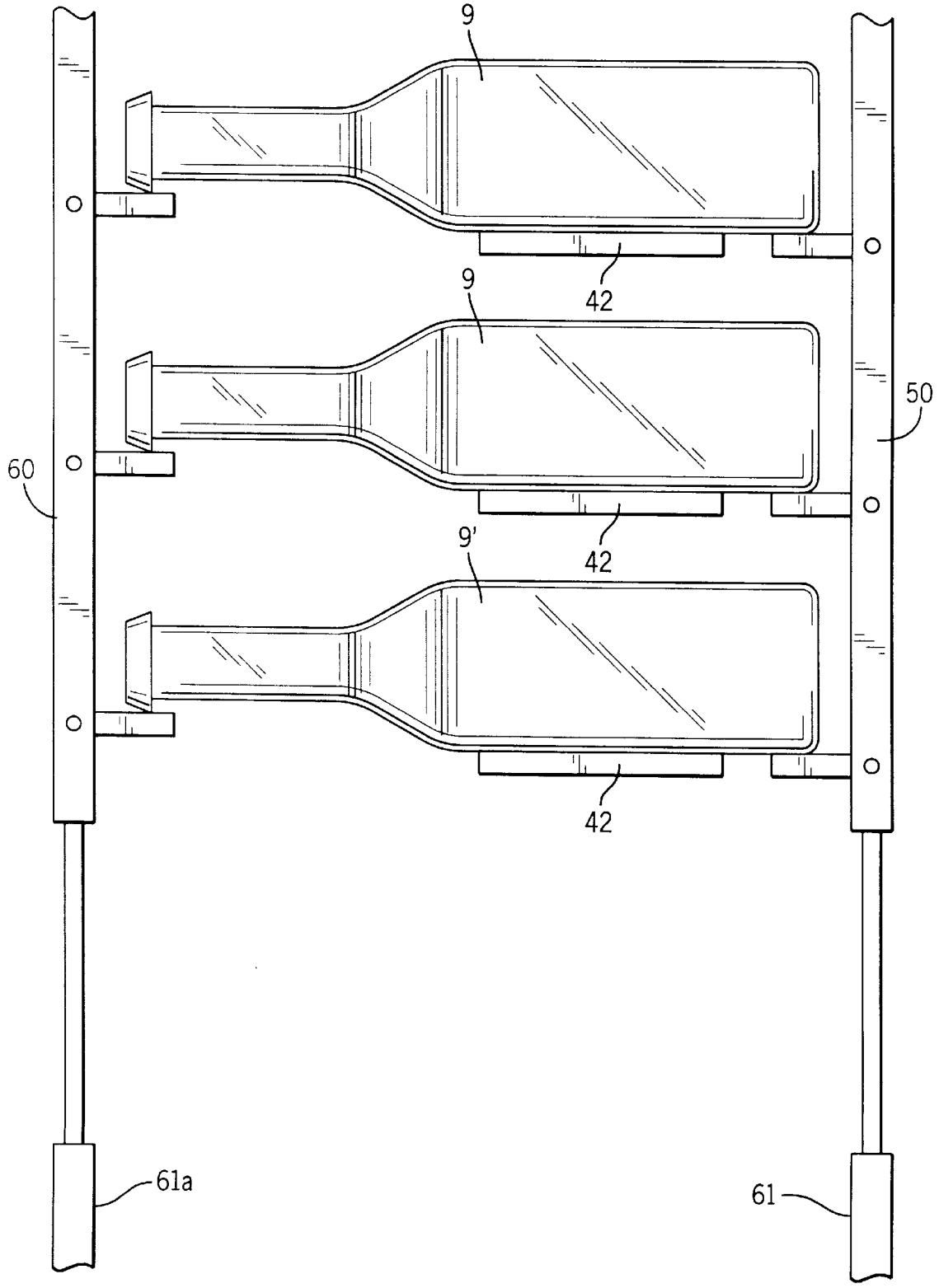
FIG. 9 is a partial view of the bottle lifting rails and the hinged bottle shelves of FIG. 4 illustrating that the bottle holding flaps are in the bottle supporting condition.

FIG. 9 shows the lifting rails 50 and 60 in the up condition with the hinged bottle shelves having pivoted downward so that the bottle hinges can now support the bottles 9, 9 and 9' as the rails are lowered.

Thus the combination of the lifting rails with their respective dogs allows one to lift the bottles upward while the hinged shelves allow the bottles to be held in place for upward movement. Once the bottles are lifted upward the top bottle rolls from hinged shelf 42 and onto the ramp 59 in the dispensing mechanism, which is shown in FIG. 3. That is bottles 9*a*, 9*b* and 9*c* are all shown on ramp 59 that slopes forward so that bottles roll toward the left. A flap 62 extends downward to maintain the cold air within the dispensing machine.

The flap 62 which comprises a flexible door that flexes to allow passage of a bottle therethrough while minimizing the loss of cool air from the refrigerated compartment. A pivotal member 81 is pivotable between a first position indicated by solid lines and a second condition indicated by dashed lines. In the first position, the pivotal member 81 prevents bottles from being dispensed from the container while in the second condition member 81 allows a bottle to roll over member 81 and out of the dispenser onto ramp 64. Dispenser 40 is shown with bottle 9*d* rolling down toward a stop 163 where the bottle can be picked up by the operator.

In the embodiment shown the bottle dispenser 40 includes a refrigeration unit 65 for directing cooling air through the interior compartment 66 of the bottle dispenser 40 and a bottle dispenser 68 so in order that cold bottles can be dispensed one at a time from the bottle dispenser apparatus 40.

In the operating condition the bottle cartridges 10, 10*a*, 10*b* and 10*c* are placed on supports within the dispenser apparatus in order to hold the bottle cartridges in position to allow bottles from the bottle cartridge to roll onto the bottle rack 42. For example, bottle cartridge 10*c* is supported by member 40*a* and 40*b*. A set of bottle stop bars are is located in dispenser 40 and is activateable through a control module. The use of bottle cartridges allows one to quickly load a plurality of bottles into the dispensing machine.

It will be envisioned that with the present invention the bottle containers are lifted vertical to a ramp where they are allowed to roll down into engagement of a bottle holder. Once member 81 is depressed the bottle is free to roll down ramp 64 to a position where a person can grasp the bottle.

While the operation of the individual components of bottle dispenser has been shown the bottle dispenser apparatus components are normally controlled by switches so that when one sequence is completed another sequence can be activated. For example, a sensor-switch (not shown) on the ramp 59 can detect when the number of bottles on ramp 59 is less than the desired number. Once the sensor-switch detects that another bottle needs to be delivered to ramp 59 a signal is sent to power source 45 to raise the lifting rails 50 and 60 which elevates another bottle onto the ramp while lifting all the other bottles in the bottle rack up one position. When the lifting rails arc lowered a further sensor-switch (not shown) activates a drive mechanism to rotate bottle stops 51, 52 53 and 54 to the open position so that bottles from the bottle cartridges 10, 10*a*, 10*b* and 10*c* can roll onto the hinged shelves 42 in the bottle rack thus readying the unit for the next cycle. A further sensor-switch (not shown) connected to a visual indicator (not shown) on the front of the dispenser can alert the user to the condition that cartridges with bottles therein need to be inserted into the bottle dispensing apparatus.

I claim:

1. An apparatus for dispensing cold bottles on demand comprising:

a cabinet, said cabinet having a cooling compartment therein;

a bottle dispensing mechanism located in said cabinet;

a bottle rack for holding a plurality of bottles thereon;

a set of bottle lifting rails, said bottle lifting rails, movable vertically between a first filling position and a second bottle delivery position;

a plurality of bottle cartridges for mounting in said compartment in said cabinet with each of said bottle cartridges postionable proximate said bottle rack to form a bottle transfer path between each of said bottle cartridges and said bottle rack;

a bottle stopper, said bottle stopper disrupting the bottle transfer path when said bottle rack is moved from the first filling position to the second delivery position; and a power cylinder connected to said bottle lifting rails for raising said bottle lifting rails, from the first filling position to the second delivery position to form a further bottle transfer path between said bottle rack and said bottle dispensing mechanism to thereby enable on demand dispensing from said appartus.

2. The apparatus of claim 1 wherein said apparatus includes a pneumatic power cylinder for raising said bottle lifting rails.

3. The apparatus of claim 1 wherein said apparatus includes a refrigeration unit for maintaining the compartment and contents therein in a cool condition.

4. The apparatus of claim 1 wherein the bottle cartridges include a bottle holder for maintaining the bottle cartridges in a non-bottle transfer condition.

5. The apparatus of claim 1 wherein the bottle cartridge is mounted at an angle in the dispensing so that the force of gravity produces a bottle dispensing force.

6. The apparatus of claim 1 wherein the bottle rack is mounted in a vertical condition and the plurality of bottle cartridges are mounted at an angle to the horizontal to allow gravity to produce a bottle transfer force.

7. The apparatus of claim 1 wherein the bottle rack includes a plurality of hinged shelves each for supporting a bottle container therein in a condition for movement to a dispensing position in said apparatus.

8. The apparatus of claim 1 including a set of dogs on said rails for engaging a bottle when the rails are elevated and for disengaging a bottle when the rails are lowered.

9. The apparatus of claim 1 wherein the bottle dispenser is located at a top of the apparatus and the bottle cartridge are located in a lower portion of the apparatus.

10. The apparatus of claim 1 wherein the cabinet includes a flexible door to allow flexing thereof to allow passage of a bottle therethrough with minimum loss of cool air within said compartment.

11. An apparatus for dispensing cold containers on demand comprising:

a cabinet, said cabinet having a cooling compartment therein;

a container dispensing mechanism located in said cabinet;

a pair of elevated rails for holding a plurality of containers therebetween, said pair of rails movable vertically between a first filling position and a second delivery position;

a plurality of container cartridges for mounting in said compartment in said cabinet with each of said container cartridges postionable proximate said elevateable rails to form a container transfer path between each of said container cartridges and said elevateable rails a container stopper, said container stopper disrupting the container transfer path when said elevateable rails are moved from the first filling position to the second delivery position;

a ramp for directing a container to a dispenser; and a power cylinder connected to said pair of rails for raising said pair of rails from the first filling position to the second delivery position to thereby deliver a container to said ramp whereby the container can be dispensed from said apparatus.

12. A bottle cartridge for holding a plurality of bottles in a dispensing condition, said bottle cartridge comprising a housing, said housing having a top, a bottom, a first side and a second side, and a first end for holding a plurality of bottles in a compartment formed therein, said bottle cartridge having an open end for insertion or removal of bottles therefrom; and a bottle stopper for preventing transfer of bottles from the bottle cartridge until the bottle cartridge is in a bottle dispensing condition; wherein a bottle stopper is located on each side of said cartridge with each having a lever handle for rotationally engaging or disengaging the bottle stopper when the bottle cartridge is located in a bottle dispenser.

13. An apparatus for dispensing cold bottle containers on demand comprising:

a cabinet, said cabinet having a cooling compartment therein;

a container dispensing mechanism located in said cabinet;

a plurality of bottle container cartridges for mounting in said compartment in said cabinet with each of said bottle container cartridges having a plurality of bottles therein with said bottle container cartridges postionable proximate a bottle elevating member to form a container transfer path between each of said bottle container cartridges and said bottle elevating member;

a bottle dispensing member; and a power source connected to said elevateable member for raising said elevateable member from a first filling position to a second delivery position to thereby deliver a bottle to the bottle dispensing member where the bottle can be dispensed from said apparatus.

* * * * *